US006257020B1

(12) United States Patent
Tranier

(10) Patent No.: US 6,257,020 B1
(45) Date of Patent: Jul. 10, 2001

(54) PROCESS FOR THE CRYOGENIC SEPARATION OF GASES FROM AIR

(75) Inventor: Jean-Pierre Tranier, Paris (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/466,183

(22) Filed: Dec. 17, 1999

(30) Foreign Application Priority Data

Dec. 22, 1998 (FR) ..... 98 16243

(51) Int. Cl.[7] ..... F25J 3/04
(52) U.S. Cl. ..... 62/646; 62/645
(58) Field of Search ..... 62/643, 644, 645, 62/646

(56) References Cited

U.S. PATENT DOCUMENTS 4,595,405 6/1986 Agrawal et al. .
5,355,681 * 10/1994 Xu ..... 62/646
5,454,226 * 10/1995 Darredeau et al. ..... 62/646
5,511,381 * 4/1996 Higginbotham ..... 62/646
5,758,515 6/1998 Howard .
5,887,447 * 3/1999 Higginbotham ..... 62/643

FOREIGN PATENT DOCUMENTS 42 04 172 8/1993 (DE) .
0 661 505 7/1995 (EP) .
0 757 217 2/1997 (EP) .

* cited by examiner

*Primary Examiner*—William Doerrler
(74) *Attorney, Agent, or Firm*—Young & Thompson

(57) ABSTRACT

In an apparatus for the separation of air by cryogenic distillation, all of the air is compressed to a medium pressure. Next, one part of the air is compressed to an intermediate pressure and a fraction of this air is compressed to a high pressure. The high-pressure air is divided into at least two fractions and expanded in two turboexpanders, the cooled stream from the warm turboexpander being at least partially recycled into the warm end of the exchanger at a higher pressure. A liquid coming from the air separation apparatus vaporizes in the exchanger.

37 Claims, 8 Drawing Sheets

PROCESS FOR THE CRYOGENIC SEPARATION OF GASES FROM AIR

BACKGROUND OF THE INVENTION

The present invention relates to processes and plants for the cryogenic separation of gases from air.

DESCRIPTION OF THE RELATED ART

The pressures referred to below are absolute pressures. Moreover, the terms "condensation" or "vaporization" should be understood to mean either condensation or vaporization proper, or pseudocondensation or pseudovaporization, depending on whether the pressures involved are subcritical or supercritical.

In recent years, the use of "pump-based" processes for the production of pressurized oxygen has become widespread. These processes consist in extracting an oxygen-enriched liquid fraction from the lower part of the low-pressure column, typically at the bottom, in pumping this liquid to the required pressure, in vaporizing it and warming it to a temperature close to ambient temperature by heat exchange with the incoming air and/or a fluid enriched with pressurized nitrogen. This process therefore allows an oxygen compressor to be saved and is therefore more economical. Likewise, production may be carried out by pumping pressurized nitrogen or argon.

This widespread use of pumping processes has partly been made possible by the use of adsorption for removing, preferably, water and $CO_2$ at the reversible exchangers.

Moreover, in order to be able to vaporize the high-pressure oxygen, it is necessary to use a high-pressure heat-generating fluid (air or nitrogen-enriched fluid) which will condense by indirect exchange with oxygen, as in U.S. Pat. No. 4,303,428, and/or by isentropic expansion in a turboexpander (see U.S. Pat. No. 5,329,776), so as to balance the heat budget of the distillation part. High pressure should be understood to mean pressure greater than the pressure of the medium-pressure column of a double-column system or greater than the pressure on the condenser side of the vaporizer of a single column. The presence of a high-pressure fluid has, furthermore, favoured the use of more complex cycles with multiple turboexpanders for the production of liquid.

Examples of pumping cycles with two turboexpanders are given in documents U.S. Pat. No. 5,329,776, GB 2,251,931, U.S. Pat. No. 5,564,290 or U.S. Pat. No. 5,108,476. Unfortunately, for all the known processes, the quantity of liquid that can be produced is limited if it is desired not to increase the size of the air compressor (i.e. the flowrate at the first stage).

U.S. Pat. No. 5,758,515 discloses a process for the production of pressurized oxygen using a first turboexpander which feeds the medium-pressure column of a double column and a turboexpander fed by a supercharger, all the expanded air of which is recycled to the primary compressor of the apparatus.

SUMMARY OF THE INVENTION

One object of the present invention is to increase the production of liquid in an apparatus with a pump and two turboexpanders, without increasing the size of the air compressor, while improving the cycle performance. Another object of the present invention is to achieve better optimization of the exchange diagram for an air separation apparatus having two turboexpanders.

According to one subject of the invention, a process is provided for the cryogenic separation of gas from air in a system of columns comprising at least one air distillation column comprising the steps of:

- compressing all of the air to a medium pressure and at least one part of the air to an intermediate pressure between the medium pressure and a high pressure,
- compressing air from the intermediate pressure to the high pressure,
- dividing the compressed air at the high pressure into a first and a second fraction,
- cooling the first fraction in a heat exchanger and at least partly expanding it in a first turboexpander,
- cooling the second fraction in the heat exchanger and at least partly expanding it to the intermediate pressure in a second turboexpander,
- warming the expanded part of the second fraction (or the expanded second fraction) in the heat exchanger and recycling at least one part thereof into the air at the intermediate pressure,
- sending air from the first turboexpander to a first column, where it becomes enriched with nitrogen at the top of the column and enriched with oxygen at the bottom, and
- withdrawing a liquid coming at least partially from one column of the system and vaporizing it, optionally after pressurization, in the heat exchanger,
- characterized in that the feed pressure of the first turboexpander is not less than the feed pressure of the second turboexpander.

According to other optional characteristics of the invention, a process is provided in which:

- the inlet pressures of the first and second turboexpanders are identical or the inlet pressure of the first turboexpander is greater than the inlet pressure of the second turboexpander, preferably greater than the inlet pressure of the second turboexpander by at least 1 bar or even at least 2 bar;
- the first column forms part of a double column or a triple column;
- an oxygen-enriched stream and a nitrogen enriched stream are sent from the first column to a second column of the double column, the first column operating at a higher pressure than the low-pressure column;
- a liquid stream is withdrawn from the low-pressure column or the medium-pressure column (or the intermediate column in the case of a triple column) and vaporized by heat exchange with air;
- all of the air is compressed to the intermediate pressure;
- the intake temperature of the second turboexpander is greater than that of the first turboexpander;
- an unexpanded portion of the first fraction condenses by heat exchange with a fluid withdrawn from the column;
- the portion which condenses exchanges heat with the liquid, which vaporizes;
- an unexpanded portion of the second fraction condenses by heat exchange with a fluid withdrawn from the column;
- the portion which condenses exchanges heat with the liquid, which vaporizes;
- the liquid stream is enriched with oxygen, with nitrogen or with argon;
- several liquid streams vaporize in the heat exchanger;

a fraction of the air is cooled in a refrigerating unit;

at least one part of the second fraction is cooled in a refrigerating unit;

the outlet temperature of the refrigerating unit is the inlet temperature of the turboexpander;

the energy of at least one of the turboexpanders serves to drive one or more compressors;

one stream from the low-pressure column feeds an argon column;

an air stream is sent to the first column without having been expanded in one of the turboexpanders.

According to other aspects of the invention, a plant is provided for the cryogenic separation of gases from air by cryogenic distillation, comprising:

at least one first air distillation column, an exchange line, means for compressing all of the air to a medium pressure, means for compressing at least one part of the air to an intermediate pressure between the medium pressure and a high pressure, means for compressing air from the intermediate pressure to the high pressure, means for sending a first and a second air fraction at the high pressure to the exchange line, a first turboexpander for expanding at least one part of the first fraction, optionally to the medium pressure, a second turboexpander for expanding at least one part of the second fraction to the intermediate pressure, means for warming at least one portion of the expanded part of the second fraction, means for recycling at least one part of this portion into the air at the intermediate pressure and means for withdrawing at least one liquid from one column of the plant and means for sending it to the exchange line, characterized in that it does not include means for increasing the feed pressure of the second turboexpander with respect to the feed pressure of the first turboexpander.

According to other optional characteristics, the plant may comprise means for increasing the feed pressure of the first turboexpander with respect to the feed pressure of the second turboexpander.

By recycling the stream from the warm turboexpander at a pressure greater than the pressure of the medium-pressure column, it is possible to achieve greater efficiency in this turboexpander. This is because the isentropic efficiency of a turboexpander is higher the lower its rate of expansion (closer to 5 than to 10).

With this concept, the output of the air compressor is increased only in the last stages and not in the first stages which determine the size thereof. Moreover, by recycling the stream from the warm turboexpander at a pressure greater than the pressure of the medium-pressure column, better optimization of the exchange diagram is achieved in its warm part and this intermediate pressure may optionally be chosen as the air purification pressure, this being a very good compromise, a lower pressure resulting in an additional cost in the adsorbers, whereas a higher pressure may pose technical problems. This is an advantage over the process described in Patent Applications EP 0,316,768 and EP 0,811,816 which, although not involving a pump, recycle the stream from the warm turboexpander (and also from the cold turboexpander) at the pressure of the medium-pressure column.

BRIEF DESCRIPTION OF THE DRAWINGS

Examples of ways of implementing the invention will now be described with regard to the appended drawings in which.

DESCRIPTION OF THE PREFERRED EMBODIMENT

Figure 1:
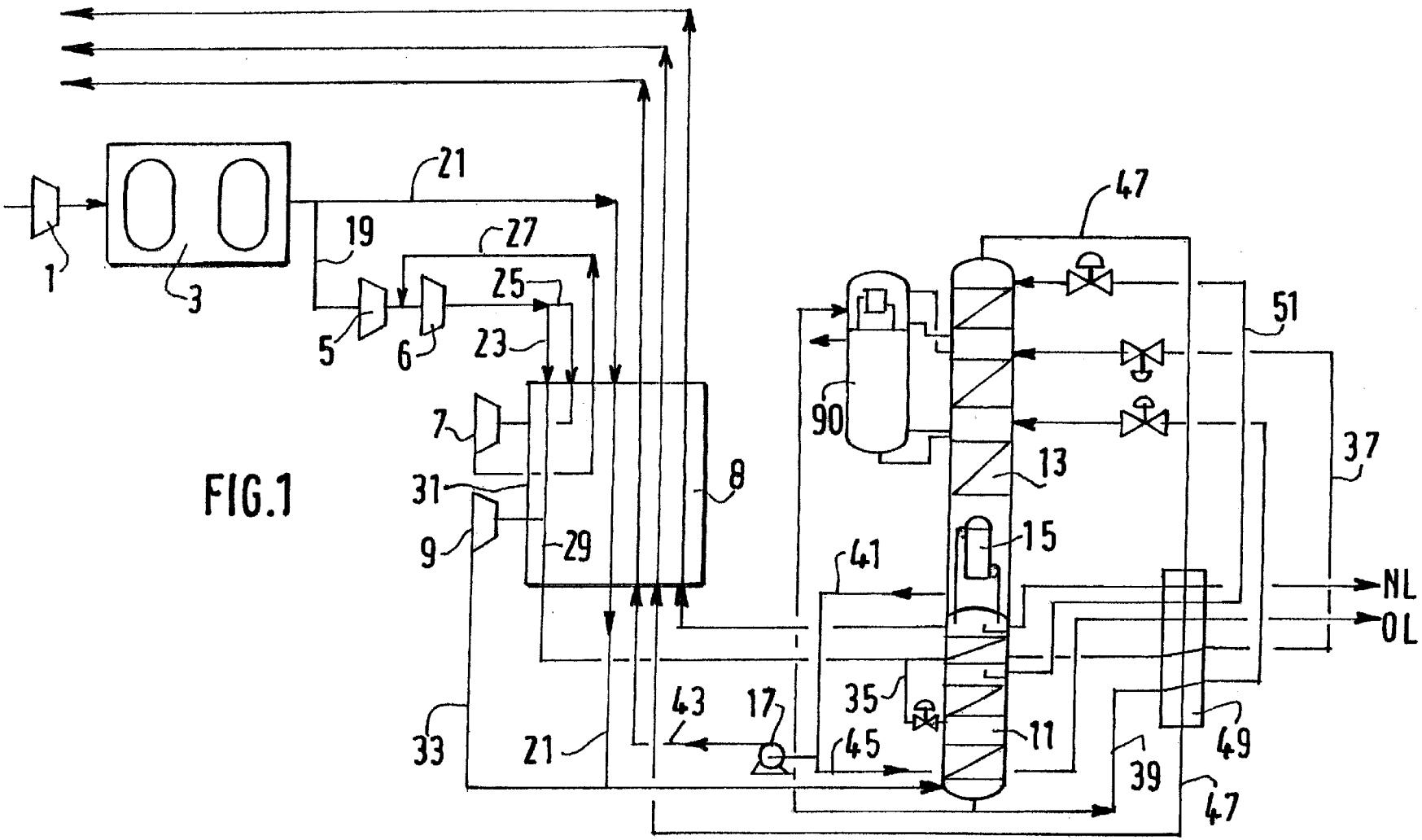
FIG. 1 illustrates diagrammatically a plant for the cryogenic separation of air according to the invention.

In FIG. 1, an air stream is sent to the compressor 1 where it is compressed to the medium pressure of about 5 bar before being purified in the purification unit 3. Next, it is divided into two parts 19, 21. One part 21, constituting 20% of the air, is sent to the heat exchanger 8 where it is cooled to its dew point and sent to the medium-pressure column 11. The part 19 is compressed in the first stages 5 of a compressor to an intermediate pressure of 11.5 bar; it is then compressed in the last stages 6 of the compressor to a high pressure of 35 bar.

The air at high pressure is divided into two fractions 23, 25, the first of which is cooled to an intermediate temperature of 160 K of the heat exchanger line 8 before being divided into two. The part 31 is expanded to the medium pressure in the first turboexpander 9 and joins the stream 21 in order to be sent to the column 11. The part 29 condenses by heat exchange with an oxygen stream which vaporizes and is divided into two in order to be sent (at 35, 37) to the two columns 11, 13, after expansion in a valve.

The second high-pressure air fraction 25 is cooled to an intermediate temperature of 243 K, greater than the inlet temperature of the first turboexpander 9. Next, it is expanded in the second turboexpander 7 to the intermediate pressure, sent to the exchanger 8 and warmed right to the warm end before being mixed with air at the intermediate pressure.

Liquid nitrogen and liquid oxygen streams 41, 45 are withdrawn from the columns 11, 13. One part of the liquid oxygen 43 is pumped, pressurized by the pump 17 to a pressure of 17 bar and then vaporized in the exchanger 8.

Optionally, it could be vaporized in an exchanger, independent of the exchanger 8, against the air stream 29.

Figure 2:
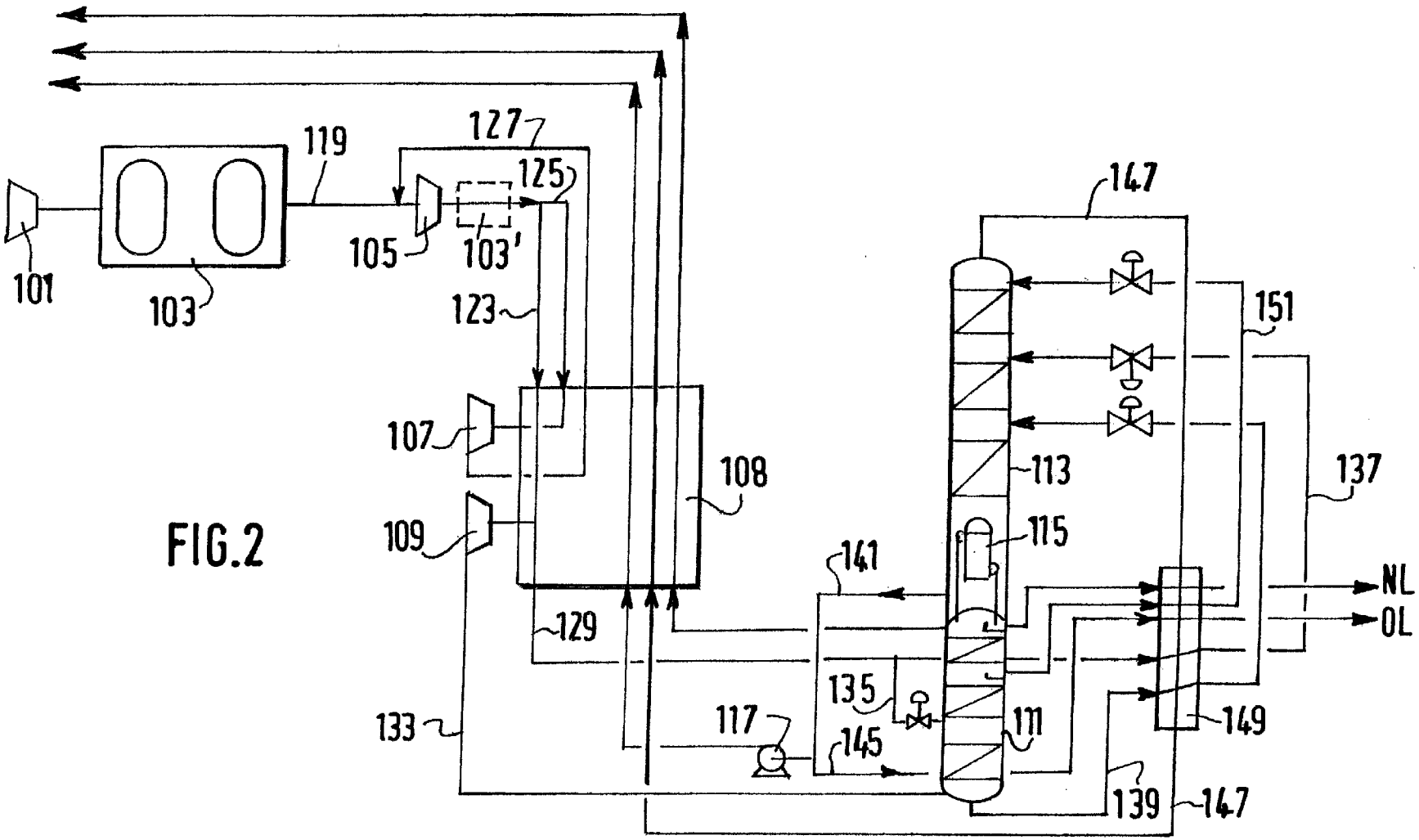
FIGS. 2 to 7 are similar views of alternative embodiments of the invention.

In FIG. 2, the same reference numbers identify the components of the plant, except that the numbers are all increased by 100.

The main difference between FIG. 2 and FIG. 1 is that, in FIG. 2, all of the air is pressurized in the compressor 105 to the intermediate pressure of 11.5 bar. The liquid oxygen 141 vaporizes against the air 129 at the intermediate pressure.

The air coming from the compressor 105 is optionally cooled in a refrigerating unit 103'.

Figure 3:
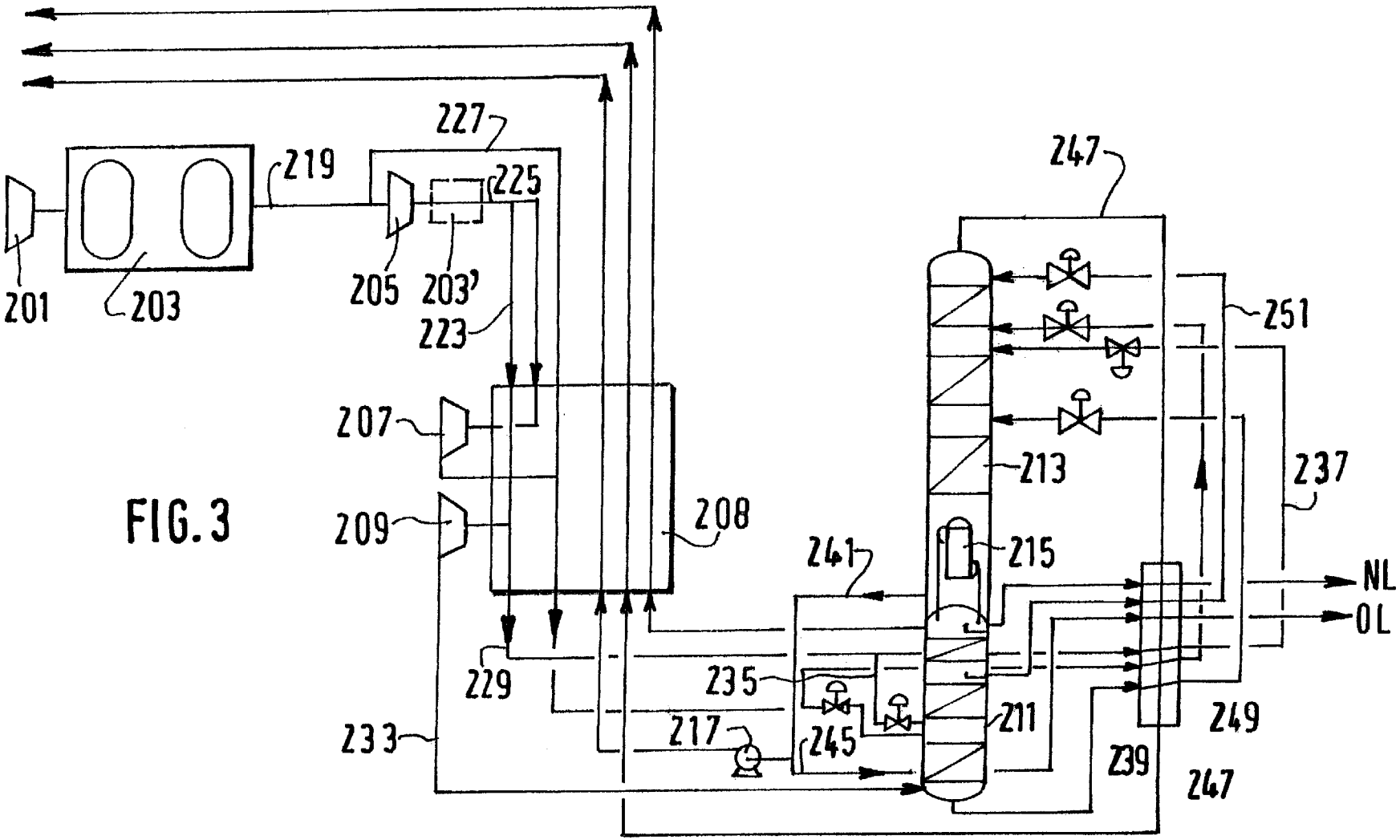

In FIG. 3, one part of the air expanded in the second turboexpander is not recycled but is sent to the double column after being liquefied through the valves. The air coming from the compressor 205 may be cooled in a refrigerating unit 203'.

Figure 4:
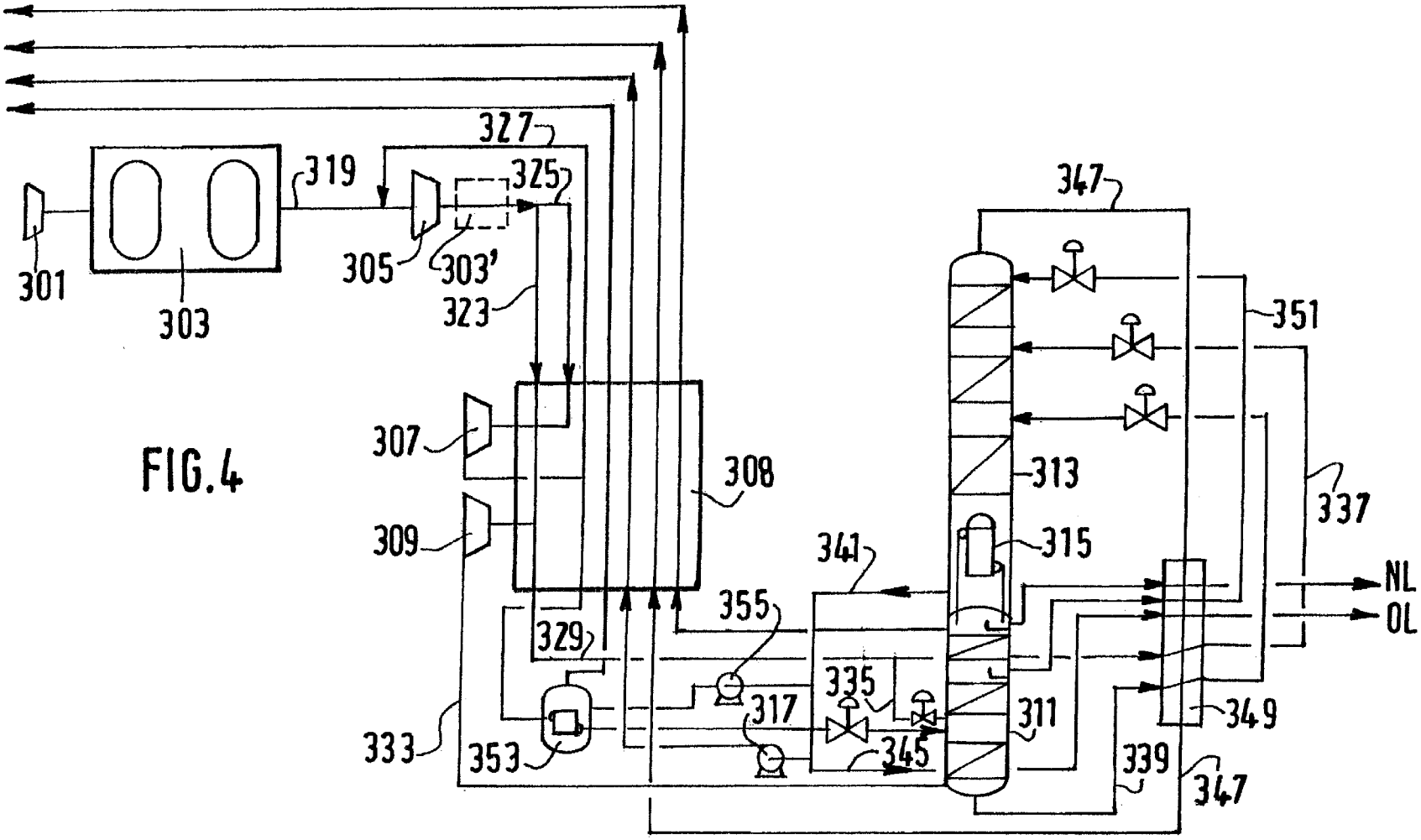

FIG. 4 differs from FIG. 3 in that the air from the second turboexpander is liquefied in the vaporizer 353 by heat exchange with the liquid oxygen pumped by the pump 317. In this case, all of the liquid air is sent to the column operating at the higher pressure. The vaporized oxygen is warmed in the primary exchanger.

Figure 5:
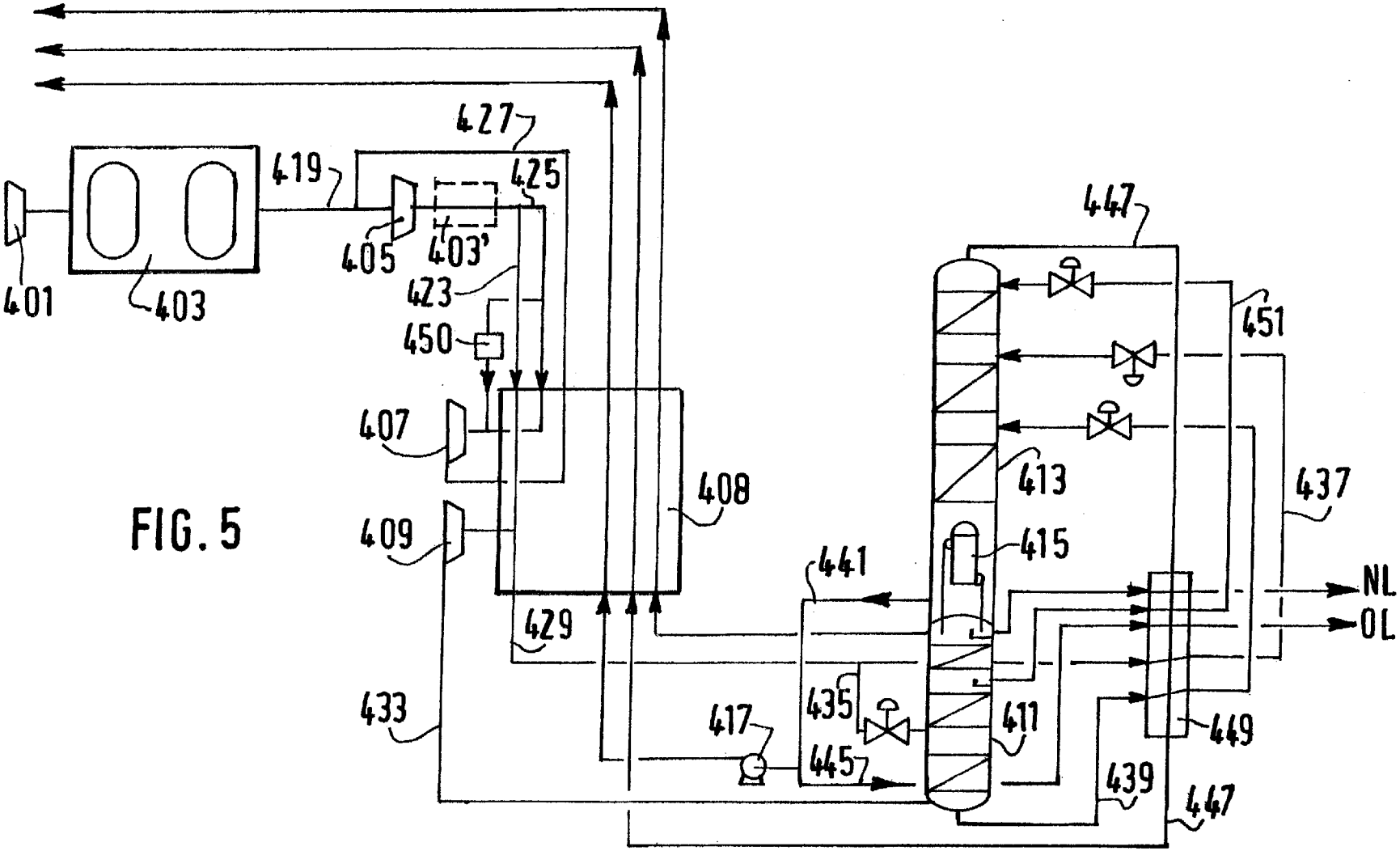

FIG. 5 shows a refrigerating unit 450 which cools one part of the air intended for the second turboexpander 407.

Figure 6:
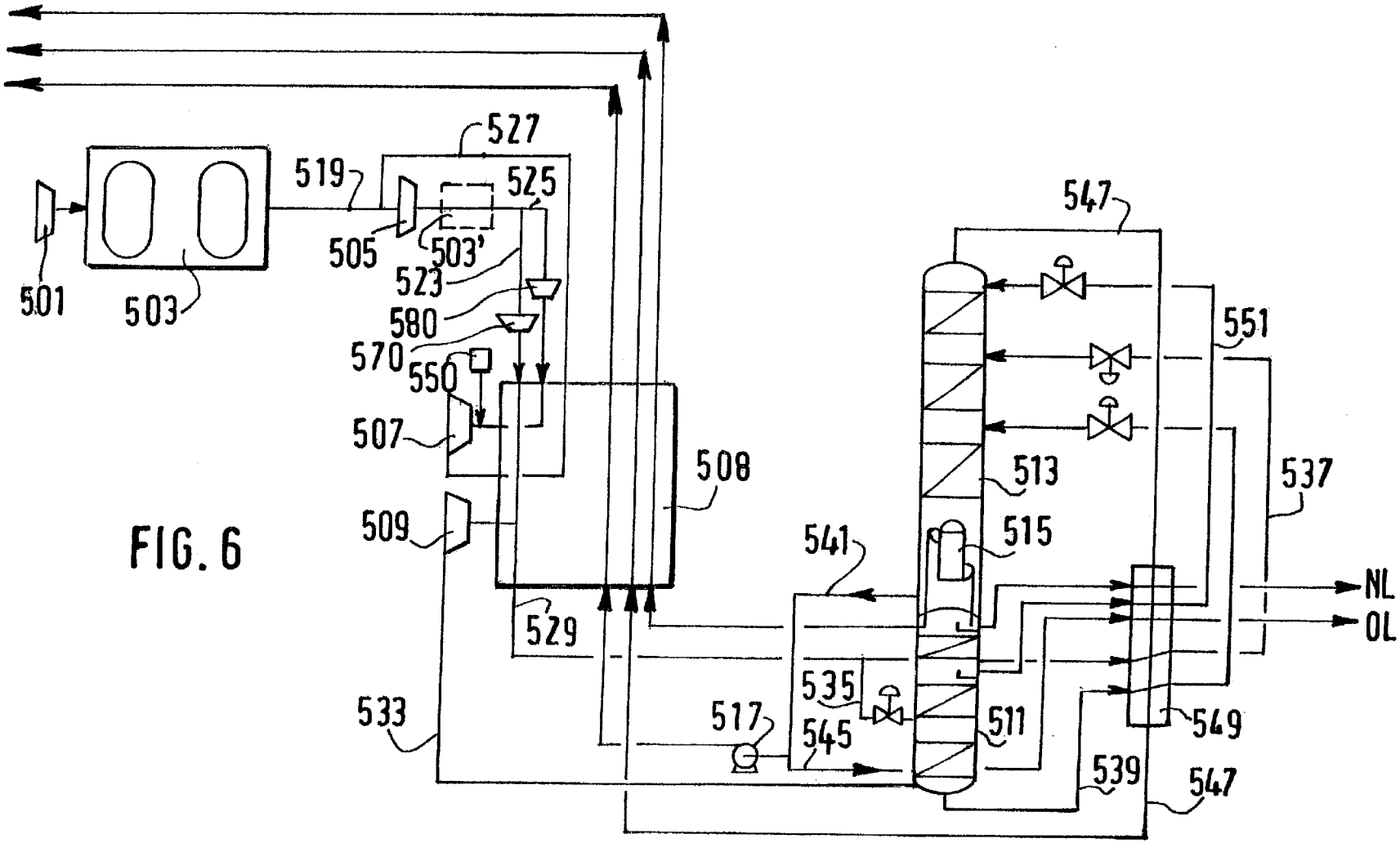

FIG. 6 shows an alternative embodiment of FIG. 1, in which air 523 intended for the first turboexpander 509 is supercharged to a pressure greater than the high pressure by a supercharger 570. The supercharger 570 may be coupled to the first turboexpander or to the second turboexpander. One part of the air intended for the second turboexpander is cooled in a refrigerating unit 550 rather than in the primary exchanger. The air 525 intended for the second turboexpander 507 is also supercharged to a pressure of less than or equal to the inlet pressure of the second turboexpander in a supercharger 580 which is coupled to the other turboexpander.

Figure 7:
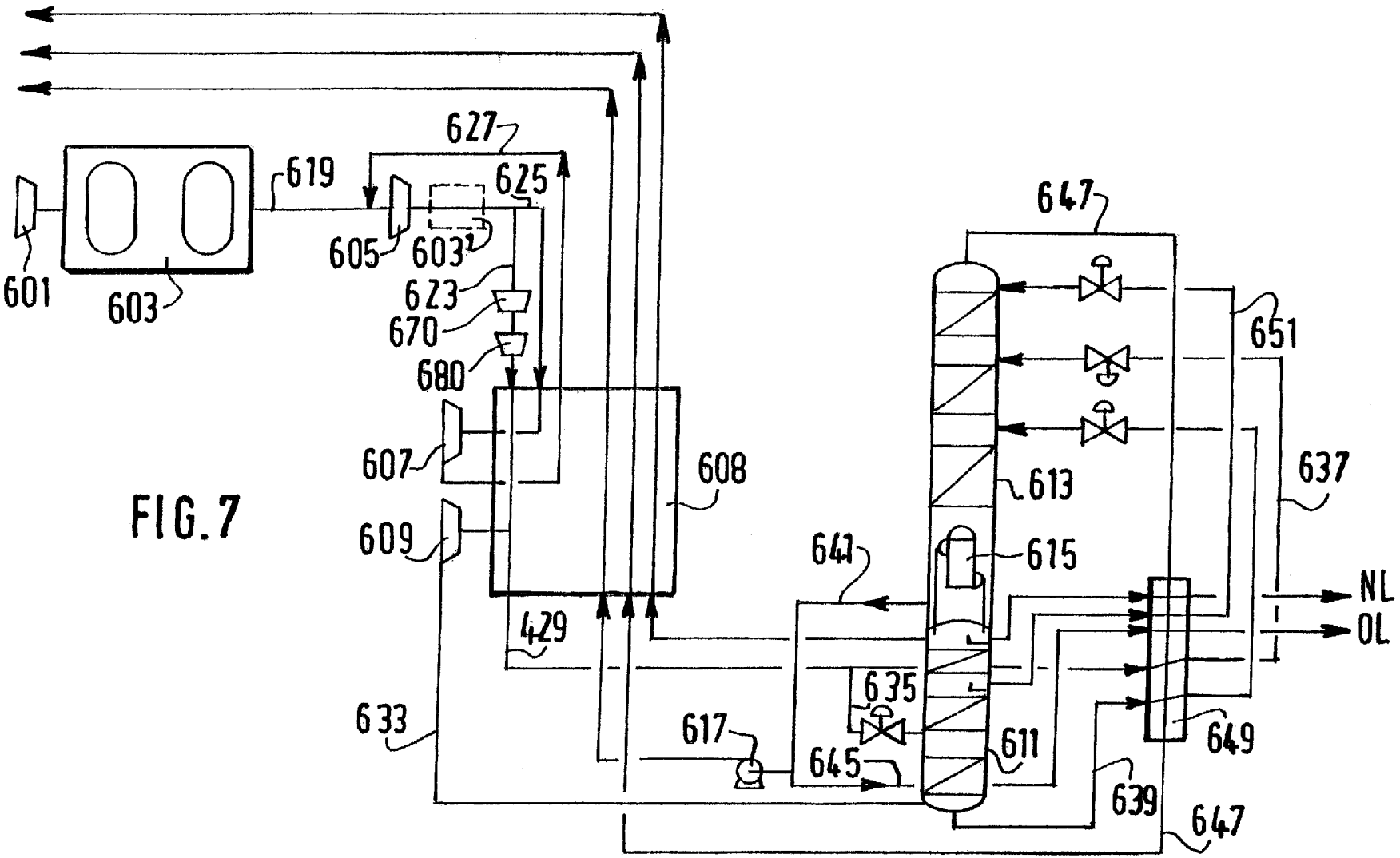

In FIG. 7, two superchargers 670, 680 supercharge the air intended for the first turboexpander 609. The air intended for the second turboexpander 607 is at the delivery pressure of the compressor 5. Each supercharger is coupled to one of the turboexpanders.

It is obviously possible to use a plant in one of the figures to produce argon from an argon column fed by the low-pressure column 13, 113 or to produce impure oxygen from a mixture column.

The first column may be a single column or the medium-pressure column of a double column. The double column may optionally be of the "AZOTONNE" (registered trademark) type having a condenser at the top of the low-pressure column.

Part of the refrigeration may be provided by the expansion of nitrogen from one of the columns in a turboexpander or by the expansion of air in a blowing turboexpander. The superchargers in FIGS. 6 and 7 may be replaced by cold superchargers.

The low-pressure column may optionally operate a pressure above 2 bar.

Figure 8:
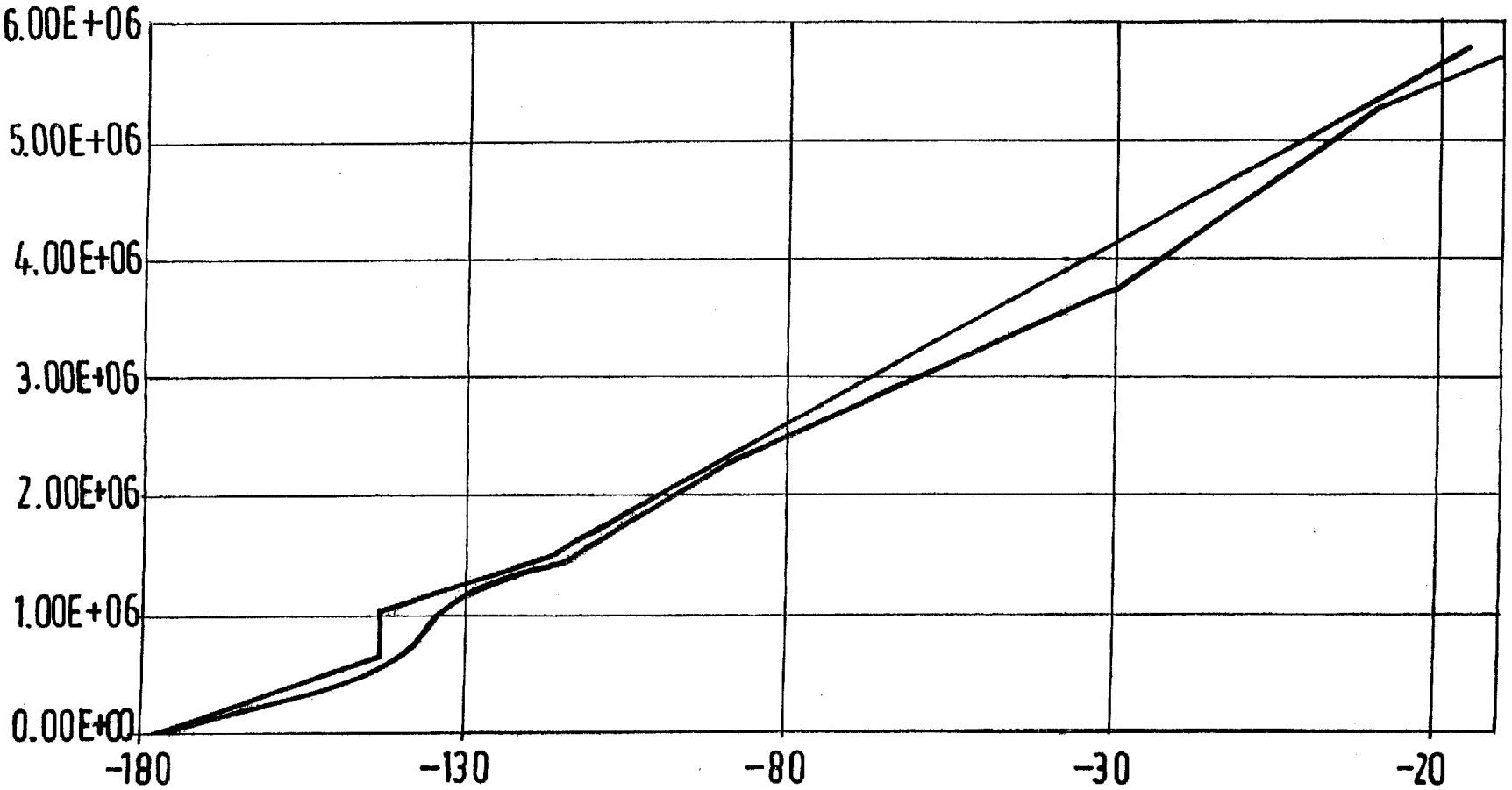
FIG. 8 is a heat exchange diagram corresponding to a use of the plant in FIG. 1.

In the case of FIG. 8, the heat exchanged in the exchange line in kcal/h is plotted on the y-axis and the temperature in °C. is plotted on the x-axis.

In all cases, the double column may be replaced with a triple column comprising a high-pressure column, an intermediate-pressure column and a low-pressure column. The liquid to be vaporized may come from one of these columns.

The plant may comprise a mixing column.

What is claimed is:

1. Process for the cryogenic separation of gas from air by air distillation in a system of columns comprising at least one column, comprising the steps of:

compressing all of the air to an intermediate pressure between a medium pressure and a high pressure;

compressing air from the intermediate pressure to the high pressure;

dividing the compressed air at the high pressure into a first and a second fraction;

cooling the first fraction in a heat exchanger and at least partly expanding the cooled first fraction in a first turboexpander to the medium pressure;

cooling the second fraction in the heat exchanger and at least partly expanding the cooled second fraction to the intermediate pressure in a second turboexpander;

warming at least one portion of the expanded part of the second fraction in the heat exchanger and recycling at least one part thereof into the air stream at the intermediate pressure;

sending the first fraction of air at the medium pressure to a first column, where it becomes enriched with nitrogen at the top of the column and enriched with oxygen at the bottom; and withdrawing a liquid from one column of the system and vaporizing the liquid at the cold end of the heat exchanger, wherein the feed pressure of the first turboexpander is not less than the feed pressure of the second turboexpander.

2. Process according to claim 1, in which the feed pressure of the first turboexpander is greater than the feed pressure of the second turboexpander by at least 1 bar.

3. Process according to claim 1, in which the first column (11, 111) forms part of a double column or a triple column.

4. Process according to claim 3, in which the first column operates at a higher pressure than a second column of the double column and in which an oxygen-enriched stream and a nitrogen-enriched stream are sent from the first column to the second column (13, 113) of the double column.

5. Process according to claim 3, in which a liquid stream is withdrawn from the first or the second column and vaporized by heat exchange with air.

6. Process according to claim 1, in which the intake temperature of the second turboexpander (7, 107) is greater than that of the first turboexpander (9, 109).

7. Process according to claim 1, in which an unexpanded portion (29, 129) of the first fraction condenses by heat exchange with a fluid (41, 141) withdrawn from the column (13, 113).

8. Process according to claim 7, in which the portion (29, 129) which condenses exchanges heat with a liquid, which vaporizes.

9. Process according to claim 1, in which an unexpanded or expanded portion (29, 129) of the second fraction condenses by heat exchange with a fluid withdrawn from the column (13, 113).

10. Process according to claim 9, in which the portion which condenses exchanges heat with the fluid, which vaporizes.

11. Process according to claim 1, in which the liquid stream withdrawn from the column (11, 13, 90) is enriched with oxygen, with nitrogen or with argon.

12. Process according to claim 11, in which several liquid streams vaporize by heat exchange with air.

13. Process according to claim 12, in which a first liquid vaporizes by exchange with the unexpanded portion of the first fraction, which condenses, and a second liquid vaporizes by exchange with an expanded or unexpanded portion of the second fraction, which condenses.

14. Process according to claim 1, in which a fraction of the air is cooled in a refrigerating unit (103, 203, 303, 403, 450, 503, 603).

15. Process according to claim 14, in which at least one part of the second fraction is cooled in a refrigerating unit.

16. Process according to claim 15, in which the outlet temperature of the refrigerating unit is the inlet temperature of the second turboexpander.

17. Process according to claim 1, in which the energy of at least one of the turboexpanders (7, 9, 107, 109) serves to drive one or more compressors (5, 6).

18. Process according to claim 17, in which the first turboexpander serves to drive a compressor which compresses the first fraction from the high pressure to an even higher pressure before the first fraction is cooled.

19. Process according to claim 17, in which the first turboexpander and the second turboexpander serve to drive compressors in series, which compress the first fraction.

20. Process according to claim 1, in which the first fraction at least partially condenses during expansion in the first turboexpander.

21. Process according to claim 1, in which the outlet temperature of the second turboexpander is close to that of the inlet of the first turboexpander.

22. Process according to claim 1, in which a stream from the low-pressure column feeds an argon column (90).

23. Plant for the cryogenic separation of gases from air by cryogenic distillation, comprising:

at least one first air distillation column;

an exchange line;

means for compressing all of the air to an intermediate pressure between a medium pressure and a high pressure, means for sending a first and a second air fraction of the air at the intermediate pressure to the exchange line;

a first turboexpander for expanding at least one part of the first fraction to the medium pressure;

a second turboexpander for expanding at least one part of the second fraction to the intermediate pressure;

means for warming at least one portion of the expanded part of the second fraction;

means for recycling at least one part of the second portion into the air at the intermediate pressure; and means for withdrawing at least one liquid from one column of the plant and means for sending the one liquid to the exchange line.

24. Plant according to claim 23, further comprising means for increasing the feed pressure of the first turboexpander with respect to the feed pressure of the second turboexpander.

25. Plant according to claim 23, in which the first column is either the column operating at the lower pressure or the column operating at the higher pressure of a double column or is one column of a triple column.

26. Plant according to claim 25, in which the first column operates at a higher pressure than a second column of the double column and in which an oxygen-enriched stream and a nitrogen-enriched stream are sent from the first column to the second column (13, 113) of the double column.

27. Plant according to claim 25, comprising means for withdrawing a liquid stream from the first or the second column or an argon column and vaporizing the liquid by heat exchange with air.

28. Plant according to claim 23, in which all of the air from the first turboexpander is sent to the one column.

29. Plant according to claim 23, comprising means for withdrawing an oxygen-enriched, nitrogen-enriched or argon-enriched liquid stream from the plant.

30. Plant according to claim 23, comprising a refrigerating unit (550) for cooling one part of the air.

31. Plant according to claim 23, comprising an argon column (90).

32. Plant according to claim 23, comprising a triple column comprising a first column operating at a high pressure fed by air, a column operating at an intermediate pressure and a column operating at low pressure.

33. Plant according to claim 32, in which the means for withdrawing a liquid from one column are connected to the high-pressure column, the intermediate column or the low-pressure column.

34. Plant according to claim 23, wherein the plant does not include means for increasing the feed pressure of the first turboexpander with respect to the feed pressure of the second turboexpander.

35. The process of claim 1, wherein only the second fraction is recycled back into the air stream.

36. The process of claim 1, wherein all of the first fraction expanded in the first turboexpander is sent to the first column.

37. Plant of claim 23, wherein none of the first fraction from the first turboexpander is recycled back into the air stream.

* * * * *